US006202661B1

(12) United States Patent
Okuda

(10) Patent No.: US 6,202,661 B1
(45) Date of Patent: Mar. 20, 2001

(54) WINDPROOF UMBRELLA

(76) Inventor: Toshio Okuda, 4-3, 1-Chome Sugi, Hirakata City, Osaka (JP)

( * ) Notice: Subject to any disclaimer, the term of this patent is extended or adjusted under 35 U.S.C. 154(b) by 0 days.

(21) Appl. No.: 09/287,108

(22) Filed: Apr. 7, 1999

(51) Int. Cl.[7] ..... A45B 25/00
(52) U.S. Cl. ..... 135/29; 135/31; 135/25.3
(58) Field of Search ..... 135/29, 31, 32, 135/25.1, 25.3, 25.31, 25.32, 22

(56) References Cited

U.S. PATENT DOCUMENTS 3,818,919 * 6/1974 Schultes et al. ..... 135/25.3
3,921,655 * 11/1975 Weber ..... 135/25.1
5,392,799 * 2/1995 Lai ..... 135/25.3
5,435,331 * 7/1995 Okuda ..... 135/31 X
5,551,463 * 9/1996 Wang ..... 135/31 X
5,597,004 * 1/1997 Okuda ..... 135/31 X
5,975,099 * 11/1999 Johnson et al. ..... 135/31 X

FOREIGN PATENT DOCUMENTS 2 110 528 6/1983 (GB) .

* cited by examiner

*Primary Examiner*—Carl D. Friedman
*Assistant Examiner*—Winnie Yip
(74) *Attorney, Agent, or Firm*—Bacon & Thomas, PLLC

(57) ABSTRACT

A windproof umbrella including a tension member formed of resilient material with inner and outer ends of the tension member being bent into hooks for connecting to the associated stay and joint member.

11 Claims, 5 Drawing Sheets

WINDPROOF UMBRELLA

BACKGROUND OF THE INVENTION

1. Field of the Invention

This invention relates to a windproof umbrella which can be automatically restored to its normally closed condition after its cover is turned inside out by a strong wind from underneath, by simply operating a slider downwardly along a shaft as in the fashion of closing the normally-open umbrella into closed condition.

2. Description of the Related Art

Various windproof umbrellas of the aforesaid type have been proposed, for example, in UK Pat. GB 2110528b, U.S. Pat. No. 5,435,331 and U.S. Pat. No. 5,597,004.

Conventional umbrellas include a tension member which plays the leading function in restoring the umbrella from its turned over condition to a normally closed condition. Such tension members are composed of a steel wire having a diameter in the range from about 1.7 to 1.8 mm, with both ends being flattened out and punched with a hole for eyelet fixing. Alternatively, the wire may have a diameter of about 1.0 mm with both ends being formed into a loop also for eyelet fixing, and pivotally connected with the eyelet or rivet to a joint member and a stay, respectively.

In fabrication of these two types of the tension members, some problems have been experienced which hinder smooth function. Specifically, in the case of a steel wire of 1.7–1.8 mm diameter, the fabrication, i.e. flattening and punching of its ends, is difficult, hence a wire having a high hardness can not appropriately be used. To cope with these problems, a wire with a moderate hardness should be selected for the tension member. However, such tension member, when subject to a larger load, such as, for example, the tight cover or the weight of the wetted cover per se, is apt to bend or deform, as a consequence, lose its desired functions of pulling and pushing the joint member located at one side thereof when opening and closing the umbrella. Another shortcoming inherent in the use of high hardness steel wire is that it will generate a bigger shock against the cover when the umbrella cover is restored from the inverted position.

As regards the steel wire of a diameter of about 1.0 mm, which is conventionally and most preferably used in forming a tension member having at its both ends formed with a loop, it can not easily be formed into a true circle loop, leading to big tolerances which affect the pulling and pushing function of the tension member. In view of the foregoing problems inherent in the currently used tension member, provision of an improved tension member is being urgently contemplated.

BRIEF SUMMARY OF THE INVENTION

In accordance with the present invention, there is provided an improved rib structure of the umbrella of the above mentioned type, comprising a shaft, a crown secured to the shaft, a slider slidably mounted on the shaft, and a plurality of spokes defining a framework for supporting a cover. Each spoke is supported on the shaft by a respective rib having a stay, a strut, a tension member and a joint member. The inner end of each strut is pivoted to the slider and the outer end of that strut is pivotally linked to the outer end of the joint member. The inner end of each stay is pivoted to the crown and the outer end is pivotally linked to an intermediate portion of the associated strut. The inner and outer ends of each tension member are pivoted respectively to an intermediate portion of the associated stay and the inner end of the associated joint member together with the inner end of each spoke being inserted inside the joint member. Each tension member is formed of resilient material. The inner and outer ends of each tension member are bent to form hooks so as to directly and pivotally connect the associated stay and the associated joint member, respectively, without using the conventional eyelets. When the umbrella is turned inside out, the tension members are curved upwardly under tension so that when the slider is pulled downwardly along the shaft, the joint members are urged strongly upward, thereby restoring the umbrella to its original condition. This hook system thus eliminates the eyelet, which often breaks and fails on conventional windproof umbrellas.

BRIEF DESCRIPTION OF THE SEVERAL VIEWS OF THE DRAWINGS

The present invention will now be described, by way of example, with reference to the accompanying drawings, in which.

DETAILED DESCRIPTION OF THE INVENTION

Figure 1:
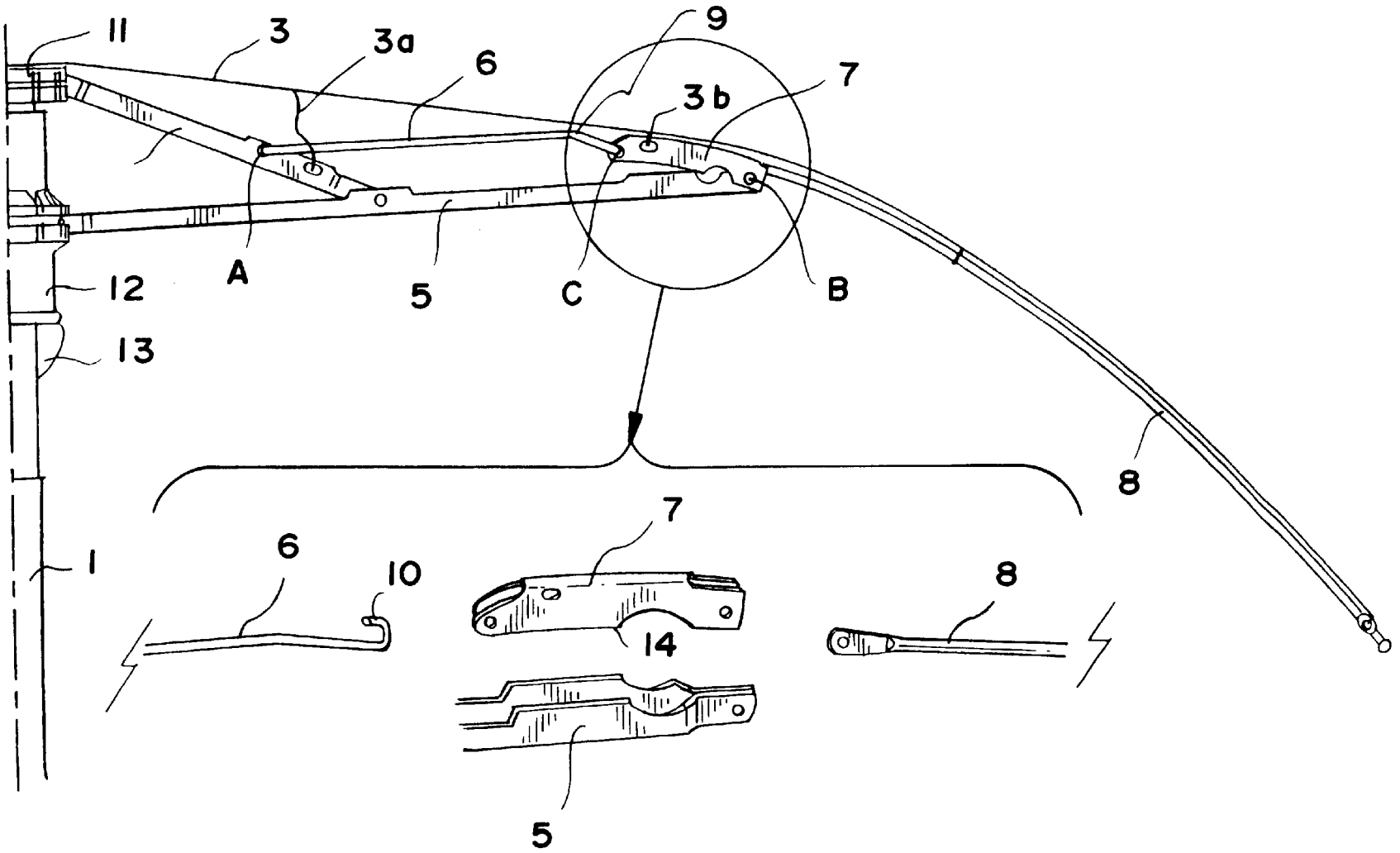
FIG. 1 is a partial front view of the umbrella in open condition, showing the improved portion of the invention with an enlarged exploded view of the encircled portion.

As seen in FIG. 1, the umbrella according to the invention has in the known way a shaft 1, with a crown 11 secured to its upper end, a slider 12 slidably provided on the shaft, and ribs consisting of stays 4, struts 5, tension members 6, joint members 7 and spokes 8. The struts 5 are pivoted to the slider 12, the outer ends of the struts being linked through the joint members 7 to the spokes 8. The inner ends of the stays 4 are linked to the crown 11, and the outer ends of the stays are pivotally connected to intermediate portions of the struts 5. The tension members 6 have their inner ends linked to intermediate portions of the stays at point A, and the outer ends are linked to the inner ends of the joint members 7 at point C. Numerals 3 is the umbrella cover whilst 3*a* and 3*b* each represents a thread for securing the cover to the members shown in the drawings.

The improvement provided by the invention resides in the tension members 6, where both ends of each tension member 6 being bent into hooks 10 and pivotally connected to the associated stay 4 and the associated joint member 7, respectively at the point A and the point C.

Figure 6:
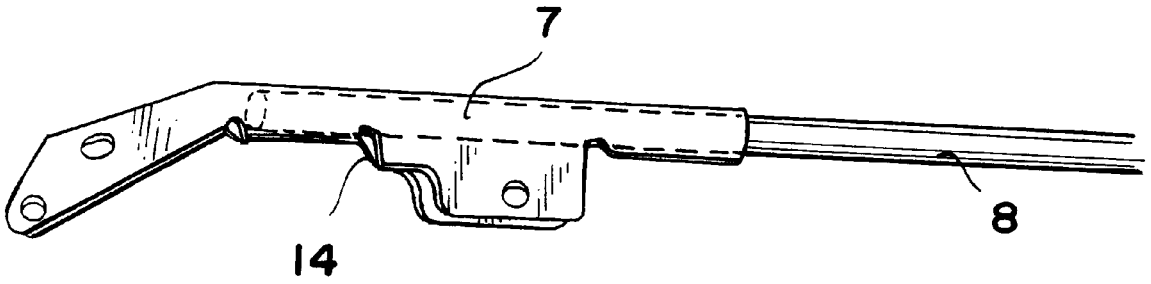
FIG. 6 is perspective view of another embodiment of the joint member, in which the inner end of spoke is fixed.

Advantageously, each joint member 7, as shown in FIG. 1 and FIG. 6, has a protrusion 14 at the lower side thereof. The protrusion 14 abuts the strut 5 immediately after the slider 12 is released from the catch spring 13, when the umbrella in a turned over condition is restored to its closed position. The tension members 6 may each be formed from a small sized resilient material, for instance, a straight steel wire or a steel wire with a convex portion 9 having a diameter of around 1.1 to 1.5 mm, normally about 1.2 mm, to decide depending on the size of umbrella.

Figure 2:
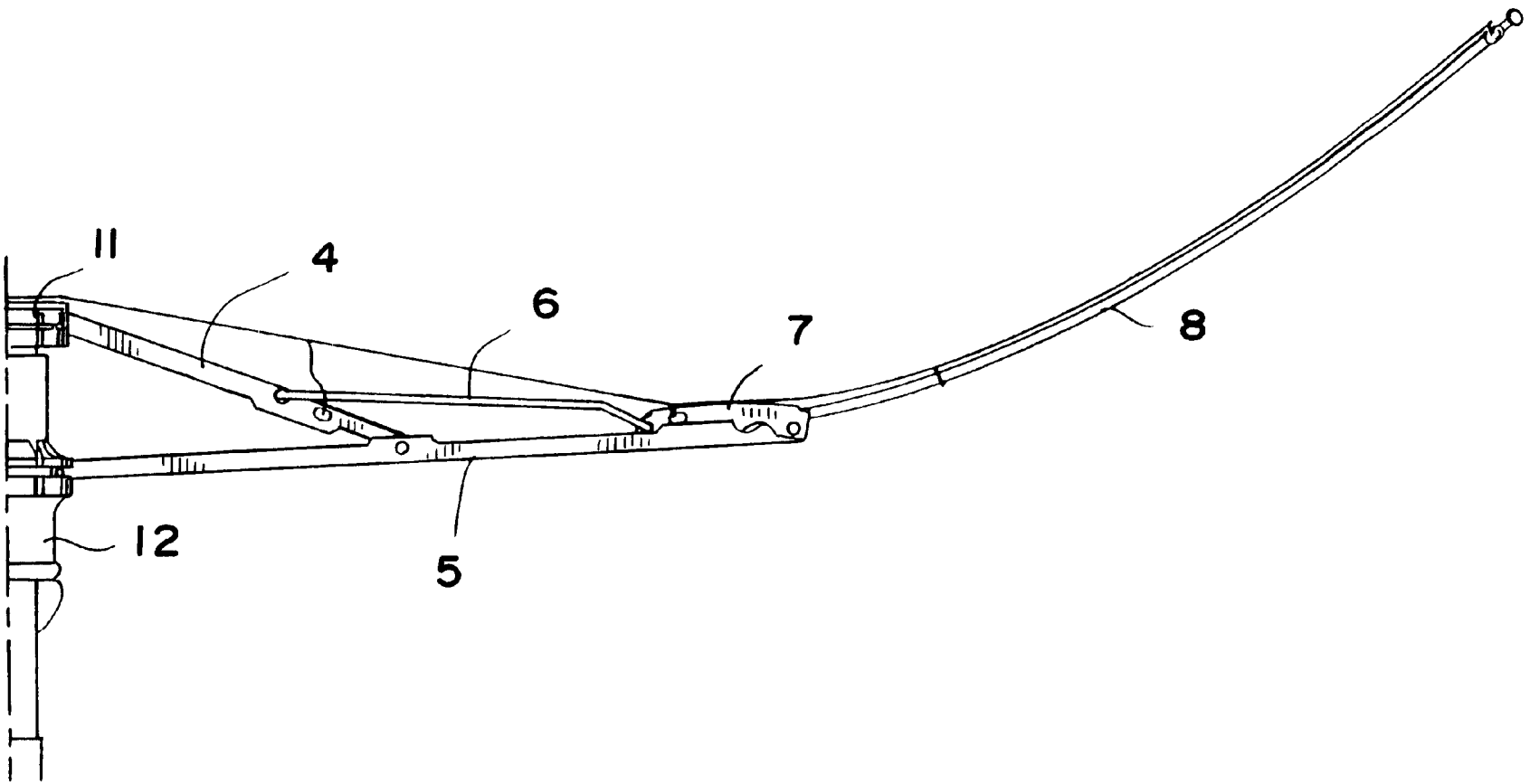
FIG. 2 shows the inverted condition of the umbrella.
Figure 3:
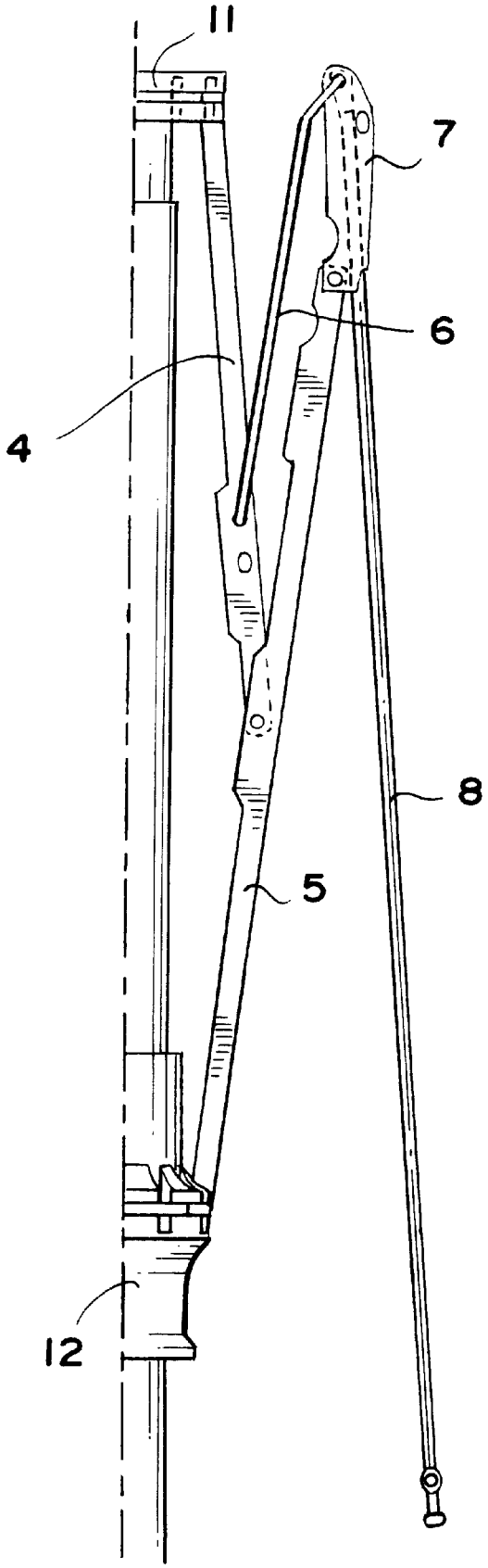
FIG. 3 shows the closed ribs or skeleton of the umbrella of the invention in partial view.
Figure 4:
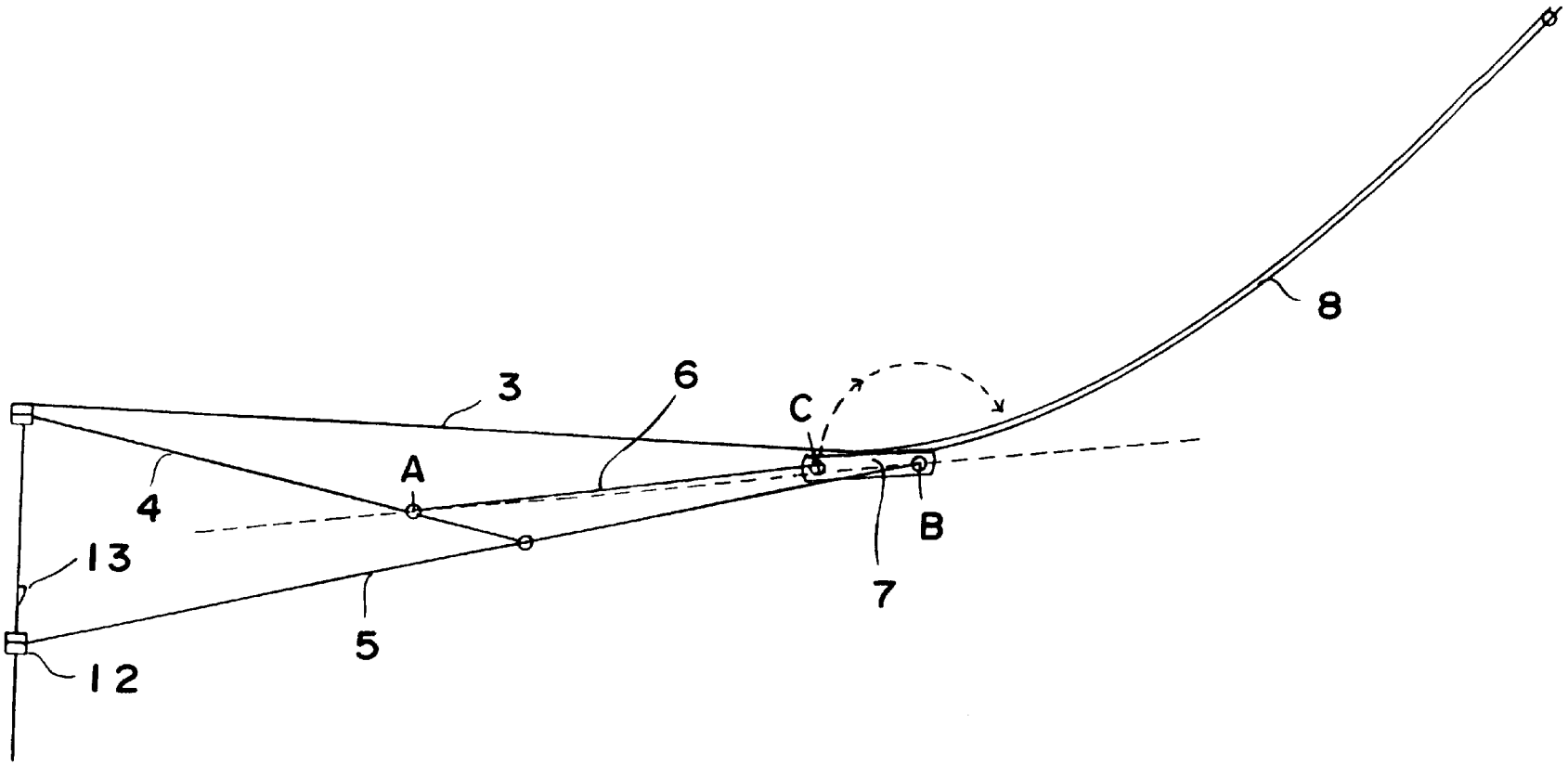
FIG. 4 is a schematic representation in partial front view of the tuned over umbrella, showing the relative positions of the pivotal points of A, B and C immediately after releasing the slider from the catch spring.
Figure 5:
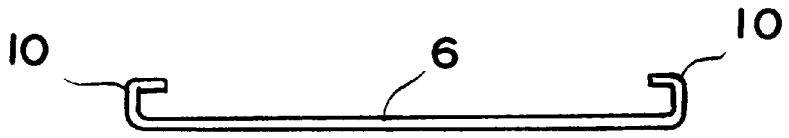
FIG. 5 is front view of a tension member of the invention.

The tension members 6 have been so constructed in the aforesaid manner. Thus, when the umbrella is subjected to a strong wind causing the umbrella to turn inside out, and to take the position as represented in FIG. 2, each tension member 6 will be automatically curved upwardly. In the operation of the umbrella from the inside out condition of FIG. 2 to the normally-closed condition of FIG. 1, the slider 12 is to be simply moved downward along the shaft 1, as in the manner of closing the umbrella from an open condition. The tension members 6 then urge the joint members 7 to move upward about the pivotal point B, as shown in FIG. 4. As the result of this movement, the spokes 8 move gradually downward to restore the normal condition, and finally resume the closed condition as shown in FIG. 3.

The protrusion 14 of the joint member 7 abutting on the strut 5 ensures the pivotal point C to always locate at a position above the connecting line of pivotal points A and B, whereby the joint member can positively move upward along the dotted line in the FIG. 4 as the tension member pushes point C of the joint member.

What is claimed is:

1. In a windproof umbrella of the type having a shaft, a crown secured to the shaft, a slider slidably mounted on the shaft, and a plurality of spokes defining a framework for supporting a cover, each spoke being supported on the shaft by a respective rib, each rib being constituted by a stay, a strut, a tension member and a joint member, the inner end of each strut being pivoted to the slider and the outer end of that strut being pivotally linked to the outer end of the joint member, the inner end of each stay being pivoted to the crown and the outer end of that stay being pivotally linked to an intermediate portion of the associated strut, the inner and outer ends of each tension member being pivoted respectively to an intermediate portion of the associated stay and the inner end of the associated joint member, and the inner end of each spoke also being pivotally connected to the outer end of tension member, the improvement comprising:

each tension member is formed of resilient material, the inner and outer ends of each tension member bent into hooks directly pivotally connecting the associated stay and the associated joint member through holes on said stay and said joint member, respectively, said one end of the spoke includes a hole that receives said second hook so that, when the umbrella is turned inside out, the tension members are curved upwardly under tension, and when the slider is pulled downwardly along the shaft, the joint members are urged upwardly, thereby restoring the umbrella to its original condition.

2. A windproof umbrella as claimed in claim 1, wherein each joint member has a protrusion at the lower side thereof whereby allowing the protrusion to abut on the strut immediately after the slider is released from a catch spring when the umbrella in an inverted condition, will restore the umbrella to its closed position.

3. A windproof umbrella as claimed in claim 1, wherein each tension member is made from a highly resilient material having a diameter of around 1.1 mm to 1.5 mm.

4. The umbrella recited in claim 2, wherein each tension member is made from a highly resilient material having a diameter of around 1.1 mm to 1.5 mm.

5. The umbrella recited in claim 2, wherein each strut includes a recess for receiving the joint member when the umbrella is in an inverted position.

6. An umbrella comprising:

a support shaft;

a strut having a first end that is pivotally and slideably secured to the shaft, and a second end;

a stay having a first end pivotally connected to the shaft above the strut and a second end pivotally connected to the strut;

a joint member having a first end pivotally connected to the second end of the strut;

a tension member having an open-ended hook on each end, the first hook being pivotally connected through a hole in the stay and the second hook being pivotally connected through a hole in a second end of the joint member;

a spoke having one end pivotally connected to the second end of the joint member; and to said second hook and a cover supported by the spoke.

7. The umbrella recited in claim 6 wherein said one end of the spoke includes a hole that receives said second hook.

8. The umbrella recited in claim 6 wherein said second end of the strut includes a cavity for receiving the second end of the joint member when the umbrella is in an inverted position.

9. The umbrella recited in claim 7 wherein said second end of the strut includes a cavity for receiving the second end of the joint member when the umbrella is in an inverted position.

10. The umbrella recited in claim 9 wherein said tension member is angled between the two hooks.

11. The umbrella recited in claim 10 wherein the tension member is a metal wire having a diameter in the range of about 1.1 to 1.5 mm.

* * * * *